US006100483A

United States Patent [19]

Horie et al.

[11] Patent Number: 6,100,483

[45] Date of Patent: Aug. 8, 2000

[54] SWITCH STRUCTURE HAVING FORCEDLY OPENING-AND-LOCKING MECHANISM EQUIPPED THEREWITH FOR EMERGENCY USE

[75] Inventors: Yoshiyuki Horie; Hiroyuki Hirose, both of Yokohama, Japan

[73] Assignee: Satori Electric Co., Ltd., Tokyo, Japan

[21] Appl. No.: 09/197,467

[22] Filed: Nov. 23, 1998

[30] Foreign Application Priority Data

Nov. 28, 1997 [JP] Japan ..... 9-327265

[51] Int. Cl.[7] ..... H01H 1/14

[52] U.S. Cl. ..... 200/437; 200/558; 200/329; 200/DIG. 42

[58] Field of Search ..... 200/325, DIG. 42, 200/329, 1 V, 1 R, 6 BA, 558, 437

[56] References Cited

U.S. PATENT DOCUMENTS 3,110,792 11/1963 Gauthier ..... 200/325 X
3,953,697 4/1976 Teichert ..... 200/243
4,216,358 8/1980 Brozille ..... 200/447

FOREIGN PATENT DOCUMENTS 62-115617 5/1987 Japan .

*Primary Examiner*—Renee Luebke
*Attorney, Agent, or Firm*—Arent Fox Kintner Plotkin & Kahn, PLLC

[57] ABSTRACT

Disclosed is an improved switch structure having forcedly opening-and-locking mechanism installed therein. It is responsive to the sticking of the movable and stationary contact elements for forcedly breaking an associated heavy-current carrying circuit which otherwise, would remain closed through the stuck contact elements. The forcedly opening-and-locking mechanism comprises an auxiliary contact section spring-biased to retain the stationary contact element in conductive condition to the associated circuit. It is responsive to the sticking-and-rising of the movable and stationary contact elements for allowing the stationary contact element to be apart from the conductive position to the associated circuit by yielding the rising force of the stuck contact elements until the locking position is reached, in which position the stationary contact element is kept in non-conductive position.

5 Claims, 6 Drawing Sheets

SWITCH STRUCTURE HAVING FORCEDLY OPENING-AND-LOCKING MECHANISM EQUIPPED THEREWITH FOR EMERGENCY USE

BACKGROUND OF THE INVENTION

1. Field of the Invention

The present invention relates to a switch structure having a pair of main contacts for making a required electric connection between selected parts in an associated electric circuit, and particularly to such a switch structure having means responsive to one or the other main contact being partly melted and stuck to the counter contact for forcedly breaking and opening the so closed circuit.

2. Description of Related Art

Referring to FIG. 13, a conventional switch 10 is used in an electric powered carpenter tool for starting or stopping its dc motor M. The switch 10 can selectively make a series-connection of the motor M to an electric power supply E, thus putting the motor M in running condition. Otherwise, the switch 10 can selectively short-circuit the opposite terminals of the motor M to effect regenerative braking.

Referring to FIG. 14, the switch 10 has a switching mechanism installed in its casing 11. The switching mechanism can be operated by an operating lever 12. It comprises a seesaw-like lever 14 balanced in the middle with the aid of a triangular fulcrum 13, and the lever 12 has two movable contact elements 17 and 18 fixed to its opposite ends. The seesaw-like lever 14 can be tilted clockwise or counterclockwise by moving the operating lever 12 back and forth so that one end goes up when the other end goes down, allowing these movable contact elements 17 and 18 to be alternately put in contact with the counter stationary contact or 20. Two opposite terminals of the switch, which are hereinafter referred to as "Main Terminal B" and "Brake Terminal C", are connected to the opposite stationary contact elements 19 and 20, and the middle terminal, which is hereinafter referred to as "Common Terminal A", is connected to the triangular fulcrum 13 of the seesaw-like lever 12. The common terminal A is connected to one terminal of the motor M. The main terminal B is connected to one terminal of a dc power supply E, and the brake terminal C is connected both to the other terminal of the motor M and to the other terminal of the dc power supply E.

As shown in the drawing, the operating lever 12 has a spring-biased slidable piece 15 fixed to its elongated arm 16. Specifically the elongated arm 16 has a spring 15*a* contained in its cavity to urge the slidable rounded projection 15 against the seesaw-like lever 14 all the time. When the operating lever 12 is moved back and forth, the slidable rounded projection 15 is moved back and forth on the seesaw-like lever 14 to put the first or second movable contact element 17 or 18 in contact with the first or second stationary contact element 19 or 20. As seen from FIG. 14, a sub-switching device for supplying the motor M with electricity is made up by the seesaw-like lever 14, the second movable contact element 18, the second stationary contact element 20, the main terminal B and the common terminal A. Another sub-switching device for braking the motor M is made up by the seesaw-like lever 14, the first movable contact element 17, the first stationary contact element 19, the brake terminal C and the common terminal A.

When the running motor M is made to stop, the operating lever 12 is released to allow the slidable piece 15 to move leftward (in the direction indicated by arrow P2) under the influence of coiled spring 61. Then, the second movable contact element 18 departs from the second stationary contact element 20 as indicated by arrow P3, and at the same time, the first movable contact element 17 is put in contact with the first stationary contact element 19 as indicated by arrow P4, thus short-circuiting the motor M to cause the regenerative braking on the motor M. When it is desired that the motor M is put in running condition, the switch is operated to work in the opposite way.

When the sub-switching device is used repeatedly for supplying the motor M with electricity, the second movable and stationary contact elements 18 and 20 are liable to be worn and roughened on their surfaces with the result that these contact elements are melted and stuck together. When this happens actually, the motor M is continuously supplied with electricity even though the operating lever 12 is released.

It is most likely that an electric carpenter tool equipped with such switching mechanism goes to destruction when its life is close to end. To prevent the motor M from running in the destructive mode it has been proposed to equip the switching mechanism with forcedly circuit-opening means for emergency use. This is required particularly in electric saws, grinders and other handhold type of electric-powered carpenter tools for safety.

An example of a switch equipped with forcedly circuit-opening means is shown in Japanese Patent 62-115617(A). As seen from FIG. 15, it comprises a main switching mechanism for opening or closing a motor-and-power supply series-connection, and an auxiliary switching mechanism series-connected to the main switching mechanism.

As seen from the drawing, the switch comprises a plunger type of operating knob 30, a position retainer 31 fitted on the bottom of the plunger knob 30, a resilient support 32 abutting on the lower side of the position retainer 31, a main movable contact element 33 ganged with the resilient support 32, and a main stationary contact element 34 confronting the main movable contact element 33.

The auxiliary switching mechanism is made up by auxiliary movable and stationary contact elements 35 and 36. As the position retainer 31 pushes the auxiliary movable contact element 35 against the auxiliary stationary contact element 36, the auxiliary movable contact element 35 is applied to the stationary contact element 36 all the time.

In operation the pushing of the operating knob 30 causes the main movable contact element 33 to be put in contact with the main stationary contact element 34 through the agency of the position retainer 31 and resilient support 32, and the releasing of the operating knob 30 causes the main movable contact element 33 to depart from the main stationary contact element 34 under the resilient influence of the resilient support 32, while the position retainer 31 is allowed to rise and follow the operating knob 30. Thus, the auxiliary movable contact element 35 is retained to be put in contact with the auxiliary stationary contact element 36 all the time by allowing the position retainer 31 to slide on the auxiliary movable contact element 35.

Assume that the main movable contact element 33 is melted and stuck to the main stationary contact element 34 when the main switching mechanism turns on, as shown in FIG. 16. As the operating knob 30 is spring-biased upward, it is raised, leaving the position retainer 31 below, and the main movable contact element 33 is stuck to the main stationary contact element 34, thus remaining in the "on" condition. Then, the position retainer 31 is pushed rightward by the auxiliary movable contact element 35, departing from the auxiliary stationary contact element 36 to prevent the motor M from being supplied with electricity from the power supply E.

As no force is applied to the position retainer 31 from the stuck main movable contact element 33, the auxiliary movable contact element 35 is allowed to depart from the auxiliary stationary contact element 36, thereby forcedly breaking the series-connection between the motor M and the power supply E.

The forcedly circuit-opening switch, however, is large in size. The number of parts to be assembled and hence, the assembling and manufacturing cost increase accordingly. Also, disadvantageously the inner resistance of the switch is increased. The main and auxiliary switching parts must be connected outside of the switch housing. This adds one extra step to the assembling work. The contact structure is designed for microswitch, thus limiting the quantity of electric current. The switch, therefore, cannot be used as power switch in an electric-powered carpenter tool such as an electric saw; a relatively heavy current flows in the electric-powered carpenter tool. Also disadvantageously, the switch cannot be equipped with brake contacts.

SUMMARY OF THE INVENTION

In view of the above one object of the present invention is to provide a switch of simple structure which is responsive to the sticking of movable and stationary contacts for forcedly opening the switch for safety.

To attain this object a switch structure having a pair of main contacts for making a required electric connection between selected parts in an associated electric circuit, is improved according to the present invention in that it has an auxiliary contact section equipped therewith, said auxiliary contact section being adapted to be kept in contact with one of said pair of main contacts all the time for making a required electric connection between selected parts in the associated electric circuit.

Each of said pair of main contacts may comprise a stationary contact element and a movable contact element, said auxiliary contact section being adapted to be kept in contact with the stationary contact element of said one main contact.

The switch structure may comprise locking means operatively connected to said auxiliary contact section for keeping said auxiliary contact section apart from the stationary contact element of said one main contact.

The movable contact elements of said pair of main contacts may be fixed to the opposite ends of a seesaw-like lever balanced in the middle, which is connected to a common terminal.

The switch structure may comprise pushing means for applying the auxiliary contact section to said one main contact.

Other objects and advantages of the present invention will be understood from the following description of switches according to some preferred embodiments of the present invention, which are shown in accompanying drawings.

DESCRIPTION OF THE PREFERRED EMBODIMENTS

Figure 1:
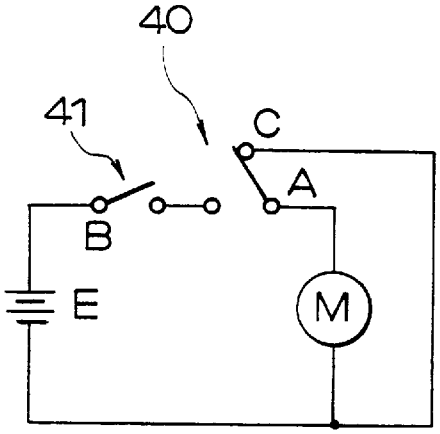
FIG. 1 is a wiring diagram of a switch according to the first embodiment of the present invention.

Referring to FIG. 1, a switch 40 according to the first embodiment of the present invention is included in a series-circuit of an electric motor M and an electric power supply E in an electric-powered carpenter tool. The switch 40 can selectively close a driving circuit for permitting the electric power supply E to supply the motor M with electricity, and can selectively close a braking circuit for short-circuiting the running motor, thereby stopping it in regenerative braking mode. The switch 40 is equipped with an auxiliary switch 41 which is responsive to the sticking of the switch contacts for forcedly opening the driving circuit for safety.

Figure 2:
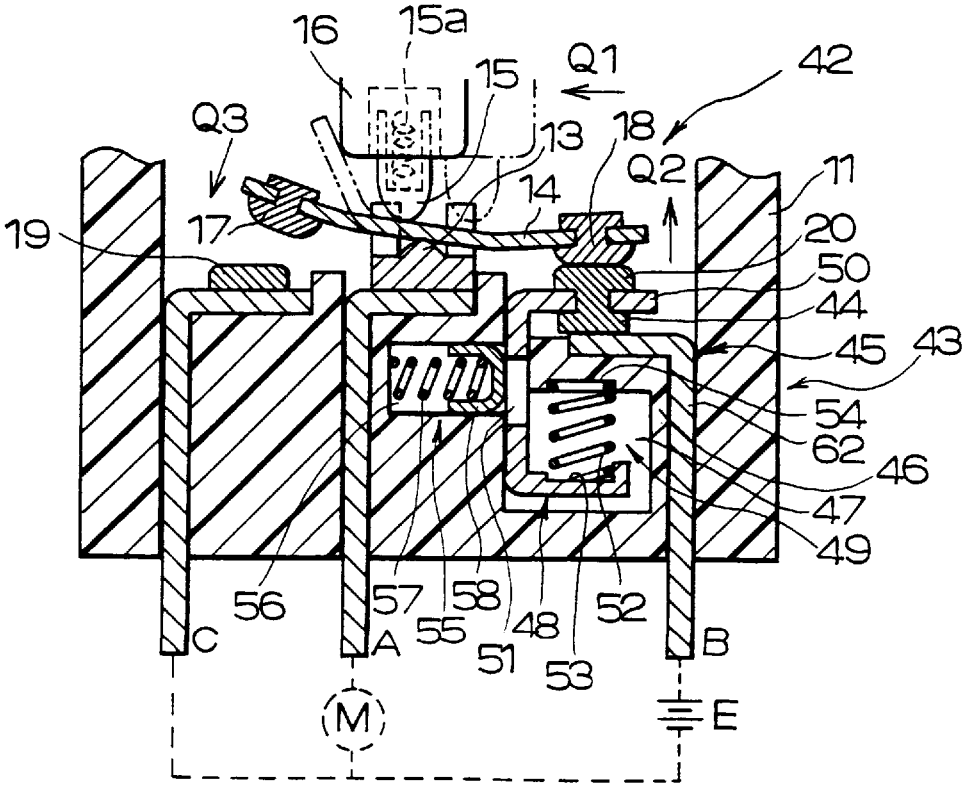
FIG. 2 is a sectional view of the switch according to the first embodiment.

Referring to FIG. 2, the switch 40 has a switching mechanism in its casing 11. The casing 11 has three terminals A, B and C partly appearing outside. These terminals A, B and C are connected to the motor M and the electric power supply E. Specifically the common terminal A is connected one of the two terminals of the motor M, and the main terminal B is connected one of the positive and negative polarity terminals of the electric power supply E. The brake terminal C is connected both to the other terminal of the motor M, and to the other terminal of the electric power supply E.

The switching mechanism includes a pair of main contacts 42 and an auxiliary contact section 43 (41 in FIG. 1). The auxiliary contact section 43 is adapted to be kept in contact with one of the main contacts all the time for making a driving circuit in which the electric power supply E is series-connected to the motor M when the switch 40 turns on the driving side.

Figure 14:
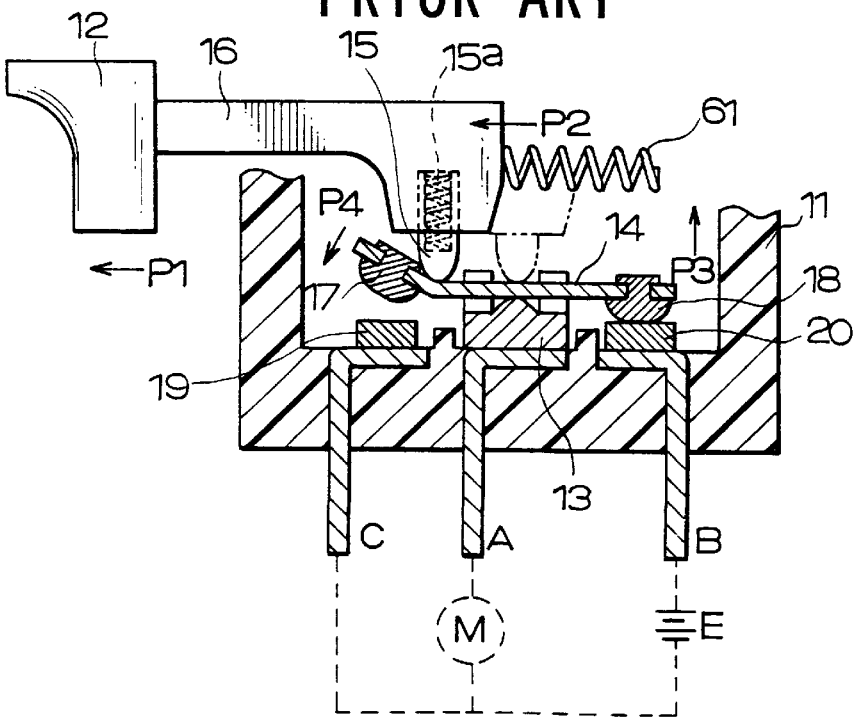
FIG. 14 PRIOR ART
FIG. 14 is a sectional view of the conventional switch.
Figure 15:
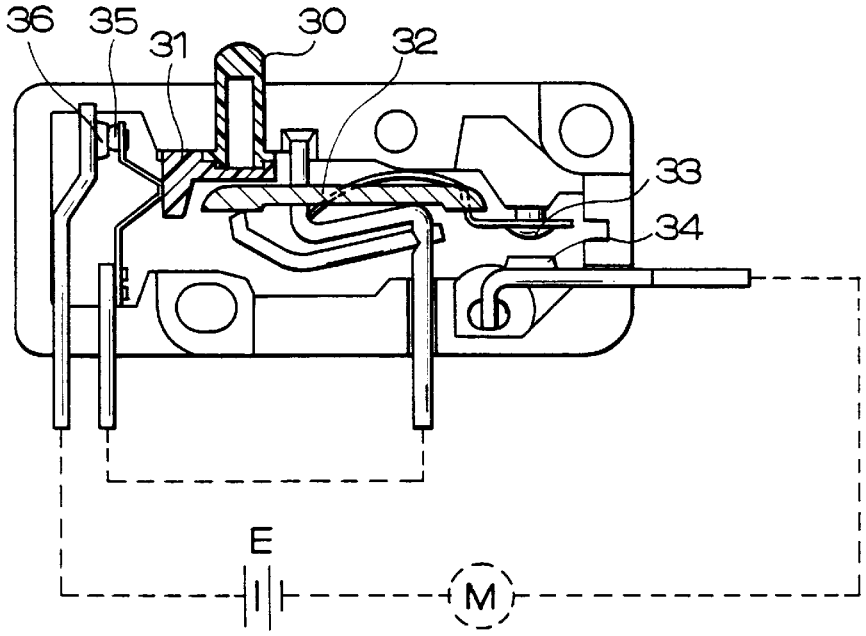
FIG. 15 PRIOR ART
FIG. 15 is a sectional view of another conventional switch having auxiliary contacts equipped therewith.
Figure 16:
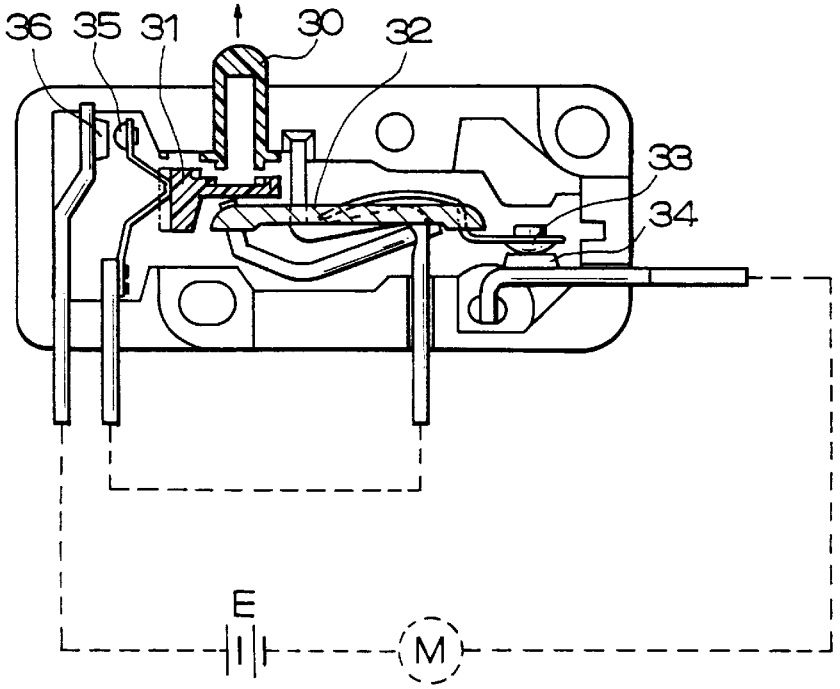
FIG. 16 PRIOR ART
FIG. 16 is a similar sectional view, but showing that the auxiliary contacts are departed in response to the sticking of the main contact elements.

Specifically a seesaw-like lever 14 has first and second movable contact elements 17 and 18 fixed to its opposite ends, and the seesaw-like lever 14 is balanced in the middle, and is supported on a triangular fulcrum 13, which is connected to the common terminal A. The seesaw-like lever 14 is operatively connected to an actuating slider 16, which is connected to an operating lever 12 (see FIG. 14). The actuating slider 16 has a rounded projection 15 attached to its tip. The rounded projection 15 is spring-biased to the seesaw-like lever 14 by an associated spring 15*a*. The seesaw-like lever 14 is so balanced in the middle that one end goes up the other end goes down when the rounded projection 15 moves toward the other end on the seesaw-like lever 14, or vice versa, thereby attaining a desired switching action. The first stationary contact element 19 confronts the first movable contact element 17, and is connected to the brake terminal C. These first stationary and movable contact elements 19 and 17 make up one of the main contacts, which is a part of a semi-switch for short circuiting the motor M thereby to stop the motor M in regenerative braking mode. Likewise, the second stationary contact element 20 confronts the second movable contact element 18, and is connected to the main terminal B via the auxiliary contact section 43. These second stationary and movable contact elements 20 and 18 make up the other main contact, which is a part of a semi-switch for permitting the power supply E to supply the motor M with electricity.

The auxiliary contact section 43 is placed between the second stationary contact element 20 of the other main contact and the stationary piece 62 of the main terminal B. Specifically the auxiliary contact section 43 is composed of an auxiliary contact element 44 integrally connected to the second stationary contact element 20 of the other main contact, a pressure retainer 45 for pushing the auxiliary contact element 44 against the stationary piece 62 of the main terminal B, and lock means 55 responsive to the sticking-and-rising of the movable and stationary contact elements 18 and 20 for retaining the movable and stationary contact elements 18 and 20 along with the auxiliary contact section 43 apart from the stationary piece 62 of the main terminal B, thereby opening the driving circuit.

The pressure retainer 45 comprises a cantilever-like terminal seat 46 on which the inverted "L"-shaped contact piece 62 of the main terminal B attached, a "U"-shaped movable piece 48 combined with the cantilever-like terminal seat 46 to define a cavity space 47, and a resilient suspender 49 for suspending the "U"-shaped movable piece 48.

The "U"-shaped movable piece 48 has a lock hole 51 made on its vertical side and a spring retainer 53 formed on its lower arm. A spring 52 is put in the space 47 defined by the cantilever-like terminal seat 46 and the lower arm of the "U"-shaped movable piece 48, and the spring 52 is caught by the lower spring retainer 53 and by the upper spring retainer 54, which is formed on the ceiling of the cavity space 47. The spring 52 thus confined in the closed space 47 provides a repulsive energy source in emergency. In the dormant position the "U"-shaped movable piece 48 is spring-biased downward relative to the cantilever-like terminal seat 46 all the time. The auxiliary contact element 44 is formed by inserting a bolt-like metal piece in the hole of the upper arm of the "U"-shaped movable piece 48 with its head remaining thereon as the stationary contact element 62 of the main terminal B, and by swaging the shank end of the bolt-like metal piece into the auxiliary contact element 44. The locking means 55 comprises a spring 57 having a lock cap 58 fixed on its end, and the capped spring 57 is put in a side hole 56, which is made in the casing wall confronting the "U"-shaped movable piece 48.

In assembling these parts into the auxiliary contact section 43, first, the spring 57 is put in the side hole 56, and the lock cap 58 is put on its end. Then, the "U"-shaped movable piece 48 is put in the cavity 47 by pushing it laterally therein with its side sliding on the confronting casing wall while the capped spring 57 is yieldingly compressed inward. Finally, the spring 52 is pushed in the cavity 47 with its opposite ends caught by the lower and upper spring retainers 53 and 54 so that the "U"-shaped movable piece 48 may be resiliently connected to the cantilever-like terminal seat 46 to push the auxiliary contact element 45 against the stationary contact element 62 of the main terminal B. It should be noted that the lock piece 58 of the capped spring 57 is positioned to be offset relative to the lock hole 51 of the "U"-shaped movable piece 48.

In operation the switch is actuated by moving the rounded projection 15 of the actuating slider 16 rightward on the seesaw-like lever 14 to push the second movable contact element 18 against the second stationary contact element 20 of the second main contact, thereby allowing an electric current to flow from the power supply E to the motor M through the stationary contact element 62 of the main terminal B, the auxiliary contact element 45, the stationary and movable contact elements 20 and 18 of the other main contact, the seesaw-like lever 14, the fulcrum 13 and the common terminal A (see FIG. 2). Then, the motor M starts running. When the running motor M is made to stop, the rounded projection 15 of the actuating slider 16 is moved on the seesaw-like lever 14 leftward (in the direction indicated by arrow Q1) to depart the second movable contact element 18 apart from the second stationary contact element 20 (in the direction indicated by arrow Q2), and push the first movable contact element 17 against the first stationary contact element 19 of the first main contact (in the direction indicated by arrow Q3). Thus, the motor M is short-circuited to cause the regenerative braking effect.

After repeating the on- and off-operations many times the second movable and stationary contact elements 18 and 20 of the other or second main contact are liable to be worn and melted on their confronting surfaces because of the heat generated by sparks appearing therebetween.

Figure 3:
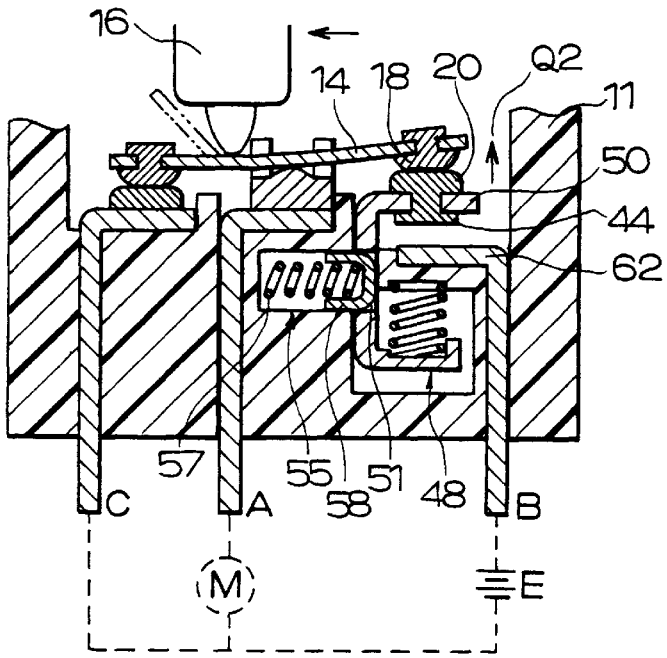
FIG. 3 is a similar sectional view, but showing the switch whose main movable and stationary contact elements are melted and stuck together.

In this instance assuming that the second movable and stationary contact elements 18 and 20 are stuck together, and that the seesaw-like lever is tilted to the braking side, these stuck contact elements will rise above from the stationary contact element 62 of the main terminal B as indicated by arrow Q2 (see FIG. 3). Accordingly the "U"-shaped movable piece 48 is raised upward as indicated by arrow Q2 to depart the auxiliary contact element 44 from the stationary contact element 62 of the main terminal B.

Then, the capped spring 57 is thrust in the lock hole 51 of the "U"-shaped movable piece 48 to hold the auxiliary movable contact element 44 firmly in the rising position, thus preventing the electric current from flowing from the power supply E to the motor M.

In this locking position the seesaw-like lever 14 cannot turn even if the rounded projection 15 of the actuating slider 16 is moved on the seesaw-like lever 14, thus preventing the motor M from running.

The forcedly opening-and-locking mechanism requires little or no extra space in installing in the switch, thus contributing to the down-sizing of the switch structure, still permitting the flowing of as heavy current as required in the electric-powered carpenter tool.

Figure 4:
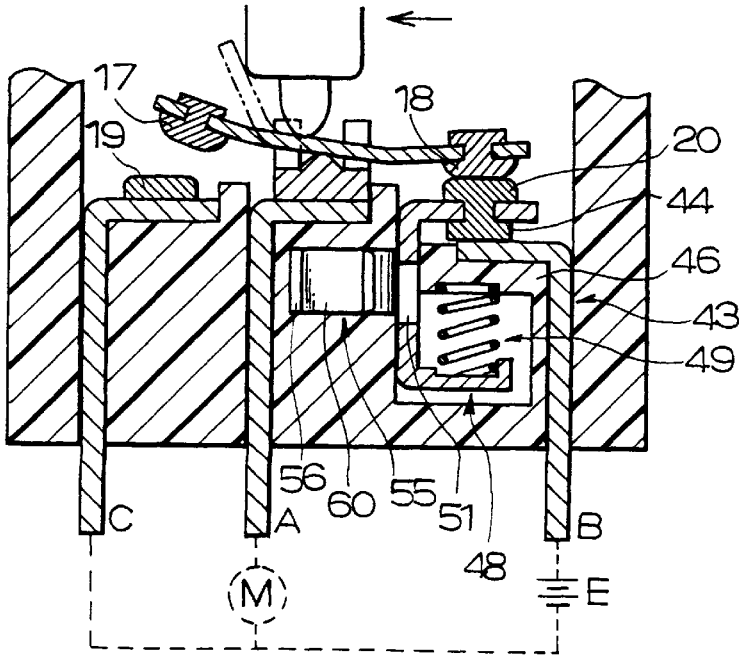
FIG. 4 is a sectional view of a switch according to the second embodiment.
Figure 5:
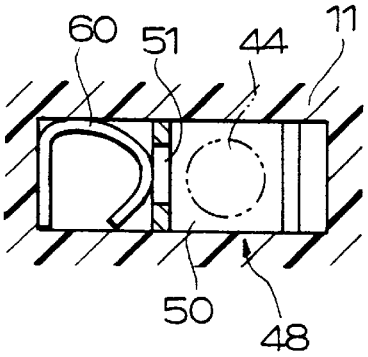
FIG. 5 is a plane view of a lock member for the auxiliary contact section in the switch according to the second embodiment.
Figure 6:
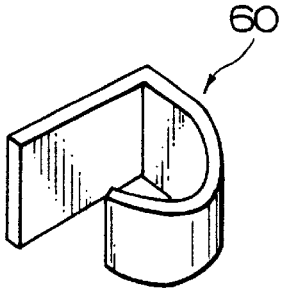
FIG. 6 is a perspective view of a plate spring of lock member.

Referring to FIGS. 4 to 6, a switch structure according to the second embodiment of the present invention is described. The first and second movable and stationary contact elements 17, 18 and 19, 20, the auxiliary contact section 43 and same other parts as in the switch structure according to the first embodiment are indicated by the same reference numerals as in FIGS. 1 to 3, and their descriptions are omitted.

The switch uses a different lock means 55. It uses a plate spring 60 in place of capped spring. As seen from FIGS. 5 and 6, the plate spring 60 is a rectangular plate bent in the middle and curved in the half length. The so bent and half-curved spring plate 60 is put in the side hole 56 with the flat half pushed against the hole bottom, thus permitting the ridge of the curved half to abut on the side of the "U"-shaped movable piece 48 all the time. Advantageously the lock means 55 is composed of a single metal piece in contrast with the capped spring, which is composed of two parts, that is a coiled spring 57 and a cap 58.

Figure 7:
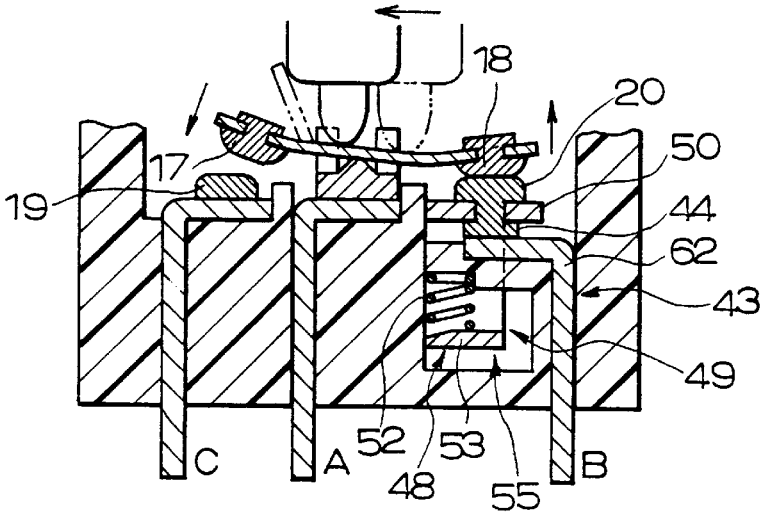
FIG. 7 is a sectional view of a switch according to the third embodiment.
Figure 8:
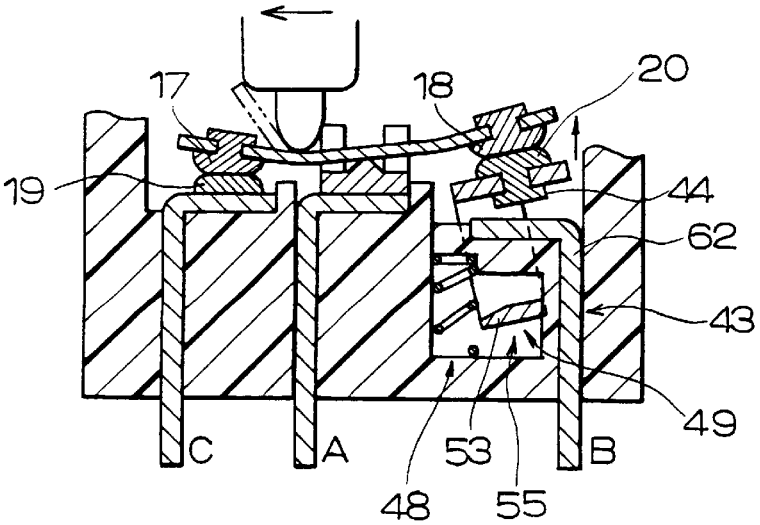
FIG. 8 is a similar sectional view, but showing the switch whose main movable and stationary contact elements are melted and stuck together.
Figure 9:
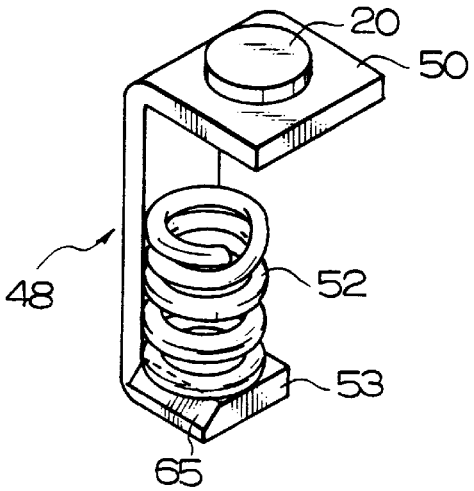
FIG. 9 is a perspective view of the auxiliary movable contact section.

Referring to FIGS. 7 to 9, a switch structure according to the third embodiment is described below. The same parts as in the switch structure according to the first and second embodiments are indicated by the same reference numerals as in FIGS. 1 to 4, and their descriptions are omitted. The switch has an auxiliary contact section 43 different from that of the switch according to the first and second embodiment.

The auxiliary contact section 43 has lock means 55 incorporated in its movable part.

As seen from FIG. 9, the auxiliary movable part 48 comprises a "U"-shaped piece whose lower spring seat 53 has a chamfered edge 65. The "U"-shaped piece is combined with the inverted "L"-shaped contact element 62 of the main terminal B with a coiled spring 52 somewhat compressed and snapped in the space defined by the cantilever-like extension of the inverted "L"-shaped contact element 62 and the lower spring seat 53 of the "U"-shaped piece.

Assuming that the second movable contact element 18 is stuck to the second stationary contact element 20 of the second main contact, and that the so stuck contact elements 18 and 20 are raised apart from the inverted "L"-shaped contact element 62, the auxiliary movable part 48 is tilted to allow the coiled spring 52 to slip off from the chamfered edge of the auxiliary movable part 48 and fall down, as seen from FIG. 8. Then, the coiled spring 52 is caught between the side wall of the casing and the tilted side of the auxiliary movable part 48, thus preventing the auxiliary movable part 48 from returning to the original position to keep the auxiliary contact element 44 apart from the contact element 62 of the main terminal B. Thus, advantageously the spring-and-movable part combination takes a role of locking.

Figure 10:
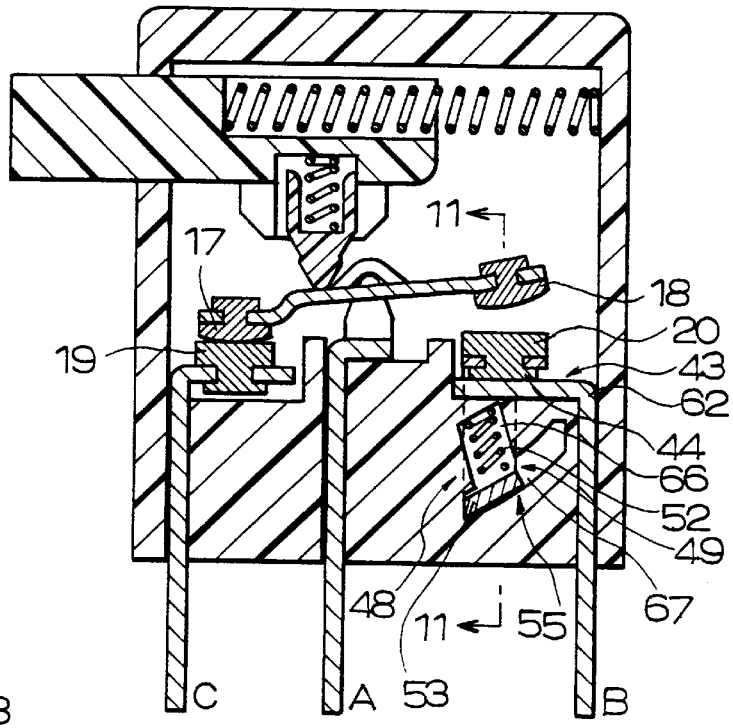
FIG. 10 is a sectional view of a switch according to the fourth embodiment.
Figure 11:
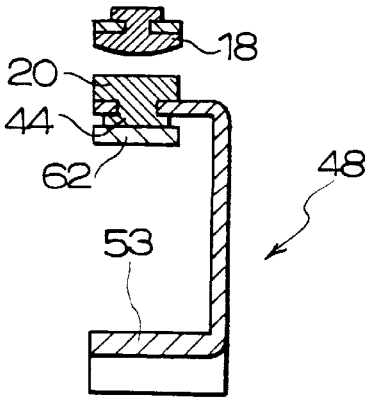
FIG. 11 is a sectional view of the auxiliary movable part of the switch.
Figure 12:
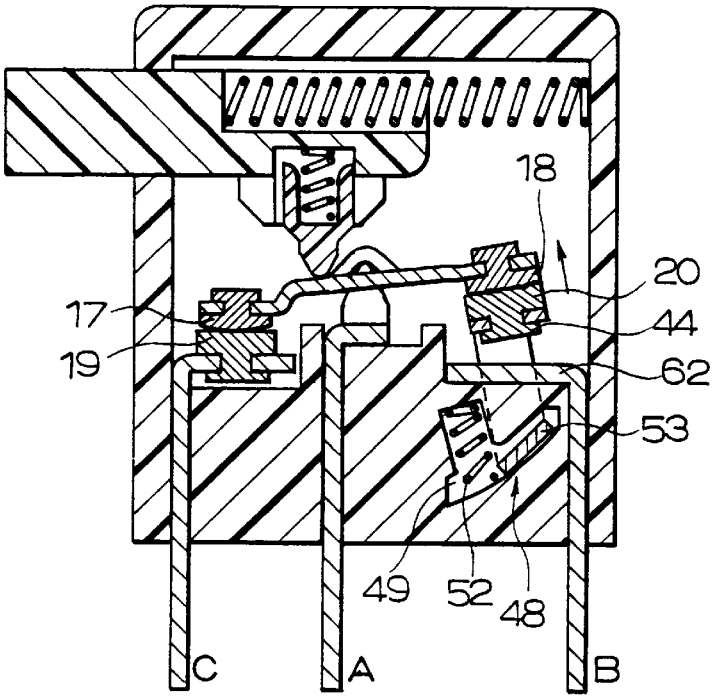
FIG. 12 is a sectional view showing the switch whose main movable and stationary contact elements are melted and stuck together.
Figure 13:
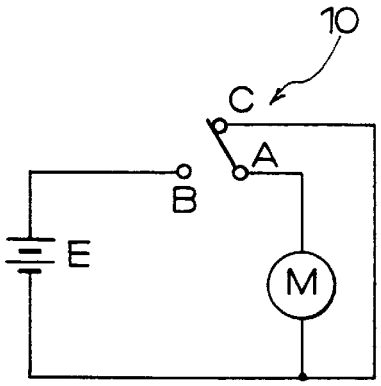
FIG. 13 PRIOR ART
FIG. 13 is a wiring diagram of a conventional switch for starting and stopping a dc motor.

Referring to FIGS. 10 to 12, a switch structure according to the fourth embodiment is described. The same parts as in the switch structures according to the first, second and third embodiments are indicated by the same reference numerals as in FIGS. 1 to 4 and 7 and 8, and their descriptions are omitted. The switch is different from the previous embodiments only in its auxiliary contact section 43.

As shown in FIGS. 10 to 12, the auxiliary contact section 43 has lock means combined with its movable part 48, which is movably fitted in an actuating space 49 made in the casing body.

The auxiliary movable part 48 comprises a "U"-shaped piece whose lower spring seat 53 is inclined up rightward in FIG. 10. The actuating space 49 is composed of a leftward-inclined longitudinal cavity 66 and a rightward-inclined lateral cavity 67 communicating with the leftward-inclined longitudinal cavity 66. The leftward-inclined longitudinal cavity 66 is so formed that the "U"-shaped piece is snugly fitted therein whereas the rightward-inclined lateral cavity 67 is so formed that the lower spring seat 53 of the "U"-shaped piece may be allowed to enter the cavity 67.

The "U"-shaped piece 48 is combined with the contact element 62 of the main terminal B with the coiled spring 52 somewhat compressed and snapped in the space defined by the ceiling of the leftward-inclined longitudinal cavity 66 and the lower spring seat 53 of the "U"-shaped piece 48.

Assuming that the second movable contact element 18 is stuck to the second stationary contact element 20 of the second main contact, and that the so stuck contact elements 18 and 20 are raised apart from the inverted "L"-shaped contact element 62, the auxiliary movable part 48 climbs the slope of the rightward-inclined lateral cavity 67 to allow the coiled spring 52 to depart from the auxiliary movable part 48, remain in the leftward-inclined longitudinal cavity 66, as seen from FIG. 12. Then, the coiled spring 52 is caught between the side wall of the leftward-inclined vertical cavity 66 and the side wall of the auxiliary movable part 48, thus preventing the auxiliary movable part 48 from returning to the original position to keep the auxiliary contact element 44 apart from the inverted "L"-shaped contact element 62. Thus, advantageously the spring-and-movable part combination takes a role of locking.

As may be understood from the above, a switch structure according to the present invention has a forcedly opening-and-locking mechanism incorporated therein, permitting the down-sizing of the switch structure. The forcedly opening-and-locking mechanism can sustain as heavy current as required in driving an electric-powered carpenter tool, and therefore, the switch structure can be installed therein to be used as power switch.

What is claimed is:

1. A switch structure comprising:

a pair of main contacts for making a required electric connection between selected parts in an associated electric circuit, wherein each of said pair of main contacts comprises a stationary contact element and a movable contact element, an auxiliary contact section being adapted to be kept in contact with one of said pair of main contacts all the time for making a required electric connection between selected parts in the associated electric circuit, said auxiliary contact section being adapted to be kept in contact with the stationary contact element of one of said main contacts, locking means operatively connected to said auxiliary contact section for keeping said auxiliary contact section apart from the stationary contact element of said one main contact, wherein the movable contact elements of said pair of main contacts are fixed to opposite ends of a lever balanced in a middle, which is connected to said auxiliary contact section.

2. A switch structure according to claim 1 further comprising pushing means for applying the auxiliary contact section to said one main contact.

3. A switch structure for making or breaking an electric circuit which contains an electric motor and an electric power supply comprising:

an actuating slider;

a first stationary terminal connected to a terminal of the electric power supply and with a first contact;

a second stationary terminal connected to another terminal of the electric power supply and with a second contact;

a third and common stationary terminal connected to a terminal of the electric motor;

a movable member which has the second contact and is biased by a spring, so as to cause electrical contact between the second contact and said second stationary terminal, in a normal state;

a lever member which is electrically connected to said third stationary terminal, the lever moves around a fulcrum, when the actuating slider is operated, and has a contact at each end, so that the electric power supply connects to the electric motor, when one of the contacts of the lever member touches the second contact of said movable member; and locking means for locking movement of said movable member, wherein when the one of the contacts of said lever member or the second contact of said movable member partially melts and sticks to each other, the actuating slider is operated to cause a contact of the other contact for said lever member with the first contact for said first stationary terminal and simultaneously cause forced movement of said movable member together with the stuck contacts, against a force of the spring, and said locking means locking said movable member after forced movement, therein interrupting the contact between said movable member and said second stationary terminal.

4. The switch structure as claimed in claim 3, wherein said locking means comprises the spring accommodated in a blind hole and a sleeve with one open end, the sleeve enters in an aperture formed in said movable member, when an opening of the blind hole aligns with the aperture.

5. The switch structure as claimed in claim 3, wherein said locking means is a leaf spring with a curved portion and is accommodated in a blind hole, which curved portion enters in an aperture formed in said movable member, when an opening of the blind hole aligns with the aperture.

* * * * *